United States Patent [19]

Yan et al.

[11] 4,181,597

[45] Jan. 1, 1980

[54] METHOD OF STABILIZING LUBE OILS

[75] Inventors: Tsoung-Yuan Yan, Philadelphia, Pa.; Robert F. Bridger, Hopewell, N.J.

[73] Assignee: Mobil Oil Corporation, New York, N.Y.

[21] Appl. No.: 901,943

[22] Filed: May 1, 1978

Related U.S. Application Data

[60] Continuation of Ser. No. 762,696, Jan. 26, 1977, abandoned, which is a continuation-in-part of Ser. No. 597,042, Jul. 18, 1975, abandoned, which is a division of Ser. No. 440,617, Feb. 28, 1974, Pat. No. 3,928,171, which is a division of Ser. No. 268,293, Jul. 3, 1972, abandoned.

[51] Int. Cl.[2] ..... C10G 37/06; C10G 41/00

[52] U.S. Cl. ..... 208/46; 208/18; 208/58

[58] Field of Search ..... 208/18, 46, 58; 260/671 R, 671 C

[56] References Cited

U.S. PATENT DOCUMENTS

| | | | |
|---|---|---|---|
| 2,130,024 | 9/1938 | Pier et al. | 208/18 |
| 2,378,762 | 6/1945 | Frey | 208/18 |
| 2,554,395 | 5/1951 | Axe | 208/46 |
| 3,463,724 | 8/1969 | Langlois et al. | 208/98 |

*Primary Examiner*—Herbert Levine

*Attorney, Agent, or Firm*—Charles A. Huggett; Vincent J. Frilette

[57] ABSTRACT

A process is provided for improving the stability of a hydrocarbon mineral oil, particularly a hydrocracked stock, normally susceptible to thermal oxidation and the effect of light rays and for decreasing the tendency of the oil to form sludge material. The process involves reacting the hydrocarbon mineral oil before or after conventional treatment, such as dewaxing operations, with a stabilizing agent, such as an olefin, alcohol, ester or alkyl halide in the presence of a heterogeneous acidic catalyst which includes acid resins, clays and aluminosilicates, and which has a controlled alkylation activity. The final oil product has improved light stability over a conventionally treated oil.

11 Claims, 13 Drawing Figures

METHOD OF STABILIZING LUBE OILS

CROSS-REFERENCE TO RELATED APPLICATIONS

This application is a continuation of patent application Ser. No. 762,696 filed Jan. 26, 1977 now abandoned, which is a continuation-in-part of abandoned U.S. patent application Ser. No. 597,042 filed July 18, 1975; which in turn is a divisional application of U.S. patent application Ser. No. 440,617 filed Feb. 28, 1974, now U.S. Pat. No. 3,928,171; which in turn is a divisional application of U.S. patent application Ser. No. 268,293 filed July 3, 1972, now abandoned.

BACKGROUND OF THE INVENTION

1. Field of the Invention

This invention relates to the production of hydrocarbon oils that are stable to thermal oxidation and resistant to the formation of sludge material. More specifically, this invention relates to the treating of hydrocarbon lube oils produced by conventional refining methods with a stabilizing agent in the presence of a catalyst to improve the properties of said lube oils.

2. Description of the Prior Art

It has been the practice to produce mineral oils, such as lubricating oils, from various hydrocarbon crude sources by fractional distillation. The crude oils and the products obtained therefrom are constituted by many different chemical components, e.g., paraffins, heterocyclics, aromatics, etc. In order to obtain good quality oils of relatively high viscosity (desirable for effective lubrication, for example), it has also been the practice to remove components which tend to lower the viscosisty index, such as polyaromtics and heterocyclic compounds, by solvent extraction. Quite often, the degree of severity of the solvent extraction conditions, i.e., concentration of solvent, time and temperature, must be increased to obtain desired properties. Solvents which have been used in commercial operations include furfural, phenol, cresylic acid, nitrobenzene, dichloroethyl ether, sulfur dioxide and others. If desired, these solvents may be used in the presence of diluents, such as benzene, carbon disulfide, ethers and carbon tetrachloride. There is, however, usually a need to add one or more additives to the solvent-treated lube oil in order to improve its resistance to oxidation and light during transfer, storage and use, as well as contributing other properties (flow, detergency, basicity, etc.).

More recently, lube oils have been obtained by a variety of processes in which high boiling fractions are contacted with a hydrogenation/dehydrogenation catalyst, in the presence of hydrogen at elevated temperatures and pressures. Additionally, lube oils have been so obtained by use of a hydrocracking catalyst. Lube oil fractions obtained from these methods can have higher viscosity index values as compared to those fractions obtained from fractional distillation of crude oils and the like. Consequently, solvent extraction treatments are generally not required to enhance the viscosity index values of the lube oil fractions which are the products of hydroprocessing and/or hydrocracking. Retaining the susceptible aromatic components, hydrocracked lube oils especially have the disadvantage of tending to be unstable to light, air, and thermal oxidation. This instability results in the formation of sediment and lacquer which decreases the commercial value of such lubricants. Previous attempts to combat this instability have included hydrogenation of hydrocracked petroleum lube oils.

U.S. Pat. No. 3,251,897 describes alkylation of aromatic hydrocarbons, such as benzene, naphthalene, and alkyl-substituted aromatics, using olefins and alkyl halides in the presence of crystalline aluminosilicates. U.S. Pat. No. 3,631,120 discloses alkylation of aromatic hydrocarbons using olefins and ammonia-exchanged crystalline zeolite having a silica-alumina ratio of 4.0 to 4.9. U.S. Pat. No. 2,904,607 discloses a process of alkylating an aromatic hydrocarbon with an olefin in the presence of a crystalline metallic aluminosilicate at 300° to 850° F. None of these references discloses the present invention.

U.S. Pat. No. 3,436,334 describes a method of contacting such an oil with oxygen and a group VIII metal or a group IIB, VIB, or VIII metal oxide. U.S. Pat. No. 3,530,061 describes a method of contacting the oil with hydrogen in the presence of a metal of the aforementioned groups. U.S. Pat. No. 3,129,183 relates to reacting a lubricating oil with an alkali metal alkyl and then contacting the metallated product with an alpha-olefin under catalyzed polymerizing conditions, the polymer replacing the metal in the oil. U.S. Pat. No. 2,741,649 describes reactng a hydrocarbon wax with an olefin in the presence of a halide acid at 400° F. to 700° F. and 100 to 15,000 psi. U.S. Pat. No. 3,574,720 describes producing a lubricating oil additive by (1) alkylating aromatics in a light cycle oil using olefins and, as the alkylation catalyst, sulfuric acid or $BF_3$ or hydrogen fluoride at from 70° to 100° F., (2) hydrogenating with a specified metal oxide catalyst, (3) sulfonating, and (4) neutralizing. None of these patents discloses the process of treating hydrocracked lubricating oil stock.

SUMMARY OF THE INVENTION

This invention provides both a method for increasing the thermal and light stability and reducing the tendency toward sludge formation in a normally susceptible hydrocarbon oil by treating a hydrocarbon fraction having a boiling point in excess of 500° F. with a stabilizing agent in the presence of an acidic catalyst, and an improved hydrocarbon oil product.

DESCRIPTION OF SPECIFIC EMBODIMENTS

Figure 1:
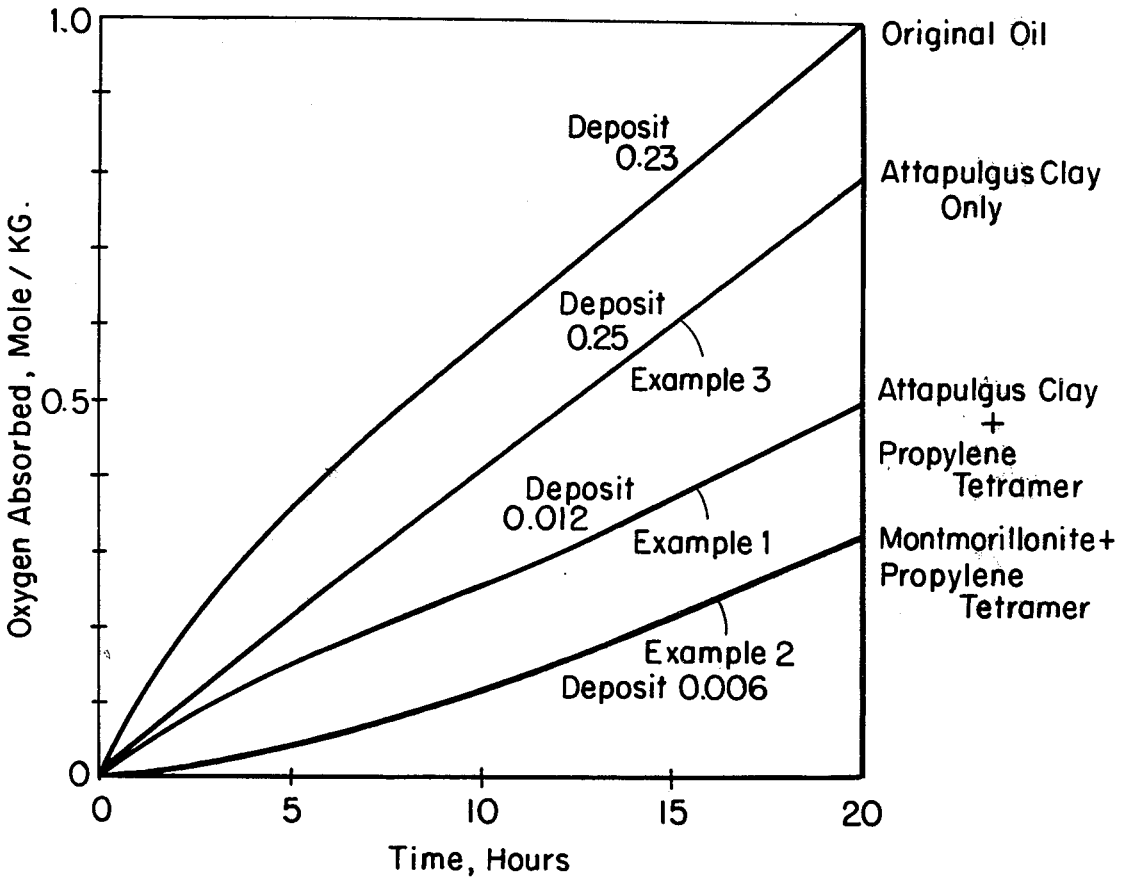
FIG. 1 depicts a comparison of the thermal oxidative stability at 175° C. of the Kuwait crude stock that has been treated in accordance with this invention (using propylene tetramer) vs. the same Kuwait stock which has not been so treated.

The hydrocarbon feed material used in the production of oils in the process of this invention can be any hydrocarbon that boils at least at 500° F. and more specifically between the range of 600° F.–1200° F. Suitable hydrocarbons include, for example, heavy gas oils, residual stocks, cyclic stocks, topped crudes, reduced crudes, and the like. These materials can be obtained by fractionation, or by vacuum distillation of crude oils. Of particular interest in this invention, in addition to the above, are the hydrocracked oils. These fractions or the hydrocracked oils are examples of feed stocks treated by the process of the present invention.

These hydrocarbons derived from known refining steps may contain wax products. Removal of wax normally follows solvent extraction or hydrocracking. It can be accomplished by any suitable conventional means used for dewaxing oils to provide an oil having a pour point below about 20° F. or lower. The process of this invention may be carried out before or after dewaxing; the dewaxing step does not eradicate the effects of the present process.

In accordance with the present invention, the treatment may be carried out batchwise or continuously at a temperature of about 20° C. to about 400° C., a LHSV of about 0.1 to about 10 (when carried out continuously) and a pressure of about 0 to about 500 p.s.i.g. The process involves admixing the oil with from 0.005% to about 25% by weight of oil, of the stabilizing agent in the presence of an acidic catalyst. A preferred range for the concentration of the agent in contact with the oil is from about 0.05% to about 15%. The preferred ranges for the above conditions are temperature of 25° to about 350° C., a LHSV of 0.5 to 2, and pressure of from about 20 to about 200 p.s.i.g.

The mechanism of the process of this invention is not entirely understood. It may be that a reaction occurs between one or more components of the oil feed stock and the stabilizing agent. For example, conditions conducive to alkylation may occur in the treatment described in the present invention. By applicants do not assert that alkylation is in fact the major reaction taking place, or whether that is the only type of reaction taking place. Different reactions may be going on with different feed stock components. For this reason, the process of this invention has been and hereinafter is referred to as either "treatment" or "stabilizing process," and the added agent as "stabilizing agent."

The stabilizing agent includes olefins having the bond group $$-\overset{|}{C}=\overset{|}{C}-$$

in which the dangling valences are attached to hydrogen, or alkyl, aryl, aralkyl, alkaryl or other alkenyl, said groups containing at least 3 carbon atoms, and preferably from 3 to about 30 carbon atoms. Such olefins as propylene, butene, hexene, decene, octadecene, butadiene, styrene, phenyl propylene, propylene and other polymers, such as propylene tetramer, and the like are suitable. Preferably 1-olefins of 2-olefins are used. The olefin can also be a mixture of olefins, or a mixture of olefins and alkanes, such as propylene/propane or butene/butane, or any other convenient mixture, e.g., olefins in a reaction product mixture from a dehydrogenation reaction. Also a light TCC or FCC gasoline can be used as the stabilizing agent.

A second class of stabilizing agents include those having the formula $$R-\underset{\underset{R'}{|}}{CH}-X$$

wherein R may be an alkyl, aralkyl, aryl or alkaryl of from 1 to about 30 carbon atoms; X may behydroxy, halo, or $$-O-\overset{\overset{O}{\|}}{C}-R';$$

and each of the R' groups may individually be hydrogen or of the same group as R. Thus, alcohols, halides and esters, preferably of from 1 to about 30 carbon atoms per organic group, may be used.

Examples of effective alcohols for this invention are methyl alcohol, ethyl alcohol, n-propyl alcohol, isopropyl alcohol, allyl alcohol, crotyl alcohol, n-butyl alcohol, isobutyl alcohol, sec-butyl alcohol, t-butyl alcohol, n-amyl alcohol, isoamyl alcohol, t-amyl alcohol, neopentyl alcohol, cyclopentanol, n-hexyl alcohol, cyclohexanol, n-octyl alcohol, capryl alcohol, n-decyl alcohol, lauryl alcohol, myristyl alcohol, cetyl alcohol, stearyl alcohol, benzyl alcohol, benzhydrol, cinnamyl alcohol, and triphenylcarbinol.

Examples of effective alkyl halides are methyl chloride, methyl bromide, methyl iodide, ethyl chloride, ethyl bromide, ethyl iodide, n-propyl chloride, n-propyl bromide, n-propyl iodide, isopropyl chloride, isopropyl bromide, isopropyl iodide, n-butyl chloride, n-butyl bromide, isobutyl chloride, isobutyl bromide, sec-butyl chloride, sec-butyl bromide, t-butyl chloride, t-butyl bromide, n-amyl bromide, isoamyl bromide, t-anyl bromide, n-hexyl bromide, n-octadecyl bromide, benzyl chloride, vinyl chlodride, vinyl bromide, allyl chloride, allyl bromide and allyl iodide.

Also effective are the carboxylic acid esters of at least 2 carbon atoms and preferably 2 to 60 carbon atoms. These include methyl formate, ethyl formate, methyl acetate, ethyl acetate, n-propyl acetate, n-butyl acetate, n-amyl acetate, isobutyl acetate, t-butyl acetate, isoamyl acetate, n-octyl acetate, methyl propionate, ethyl propionate, methyl n-butyrate, ethyl n-butyrate, isoamyl n-butyrate, methyl n-valerate, ethyl n-valerate, methyl isovalerate, isoamyl isovalerate, ethyl n-heptylate, ethyl pelargonate, benzyl acetate, methyl phenylcarboxylate, and the like. Diesters of dicarboxylic acids or dihydric alcohols are also suitable.

The catalyst used in the process of this invention is an acidic, or acid-acting, catalyst. The classes of suitable catalysts include acid resins, clays, aluminosilicates, such as zeolites, and other acidic oxides. These solid catalysts which are useful in fluid and fixed bed catalysis, being heterogeneous to the reactants, are readily separable therefrom.

Of particular interest are the resins, clays and zeolites. The resins, preferably cation exchange resins, consist of a polymeric resin matrix having acidic functional group, such as sulfonic, phosphonic, phenyl sulfonic, phenylphosphonic, phenolsulfonic, and the like. The matrix may be any resin, which is preferably porous, either initially or becoming so during the process, including specifically phenolic resin, polystyrene, copolymers of styrene with polyfunctional polymerizable monomers or partial polymers, such as styrene-divinyl aryls, e.g., divinyl benzene, or acrylates, polyacrylic or polymethacrylic acid resins, and halogenated variations of these above said resins. Sulfonated coal also provides an acid acting catalyst. Acidic clays, such as attapulgite and montmorillonite are also among the preferred catalysts. Crystalline aluminosilicates, at least partially in the hydrogen form, are also very good catalyst. They generally have the formula $$M_{2/n}O.\ Al_2O_3\ .\ ySiO_2\ .\ zH_2O$$

where M is a cation, n is its valence, y is the moles of silica, and z is the moles of water. Crystalline zeolites are well-known (U.S. Pat. Nos. 3,140,249 and 3,140,253). Modified zeolites, such as rare-earth-exchanged or other metal exchanged zeolites may be used. Rare earth-exchanged Y-types (y is over 3) and X-types (y is under 3) are examples of these. Both natural aluminosilicates, such as levynite, faujasite, analcite, noselite, phillipsite, datolite, chabazite, leucite, mordenite, and the like, and synthetic aluminosilicates are examples of satisfactory catalysts. Other catalysts which may be used in this invention include inorganic oxides such as aluminia, silica alumina mixture, thoria, vanadia, zirconia, titania, chromia, chromia-alumina, molybdena, germania, ceria, halogenated alumina, molybdena-alumina and mixtures thereof and these with any of the other foregoing classes of catalysts.

Those skilled in the art of heterogeneous catalysts recognize that there are many insoluble solids with a porous structure that are effective in inducing acid-catalyzed reactions, and that, because of this property, are referred to as "acidic". It is also recognized that these heterogeneous, acidic catalysts vary in efficacy, depending on catalyst preparation in some cases, and on other factors such as the particular reactions involved. These heterogeneous acidic catalysts may be organic, such as sulfonated polystyrene, or inorganic, such as silica-alumina cracking catalyst. The inorganic acidic catalysts exemplified in the foregoing paragraphs and elsewhere are simple or mixed inorganic oxides, which may be polymeric or hydrated to varying extent, as will be recognized by one skilled in the art. With few exceptions, the heterogeneous inorganic acidic oxide catalysts useful in this invention comprise an oxide selected from the group consisting of silicon and aluminum. Included in this group are the acidic clays, the acidic forms of crystalline aluminosilicate zeolites, and the known acidic cracking catalysts based on mixed oxides such as silica-alumina, silica-magnesia and silica-zirconia. Since not all inorganic oxides are "acidic", i.e. function to catalyze acid-catalyzed reactions, it is useful to provide an independent means for determining if a solid does function as a heterogeneous, acidic catalyst and to what extent it possesses this property.

An independent means of describing the catalysts useful in this invention is by their ability to affect the alkylation of benzene with propylene to form cumene, which is recognized by those skilled in the art of catalysis to be an acid-catalyzed reaction. In this independent reaction, 100 grams of benzene is reacted with excess propylene in the presence of 5 grams of a desired catalyst, at a temperature of from about 78° to about 80° C. Analysis by gas chromatography was used to track the reaction over a 5-day period. It has been found that catalysts having an activity rate of at least preferably about $0.003\times10^{-2}$ grams of cumene per gram of catalyst per hour (from 100 grams of benzene) provide satisfactory catalysts. Although less active catalysts are acceptable, they are less preferred for the purpose of this invention. It should be noted that without any catalyst, the reaction produces no detectable amount of cumene.

With regard to the operation of this invention, the mineral oil, preferably lube oil, to be treated, such as effluent from a solvent extraction or dewaxing operation or from a hydrocracking operation, may be mixed with the stabilizing agent and the catalyst, or the agent and feed are premixed and then mixed with the catalyst; in a continuous operation, for example, reactants may be passed over a fixed bed reactor which contains the catalyst. Catalyst contact may be carried out at between about 25° to 350° C., and most preferably from 90° to 280° C. The treated oil is recovered by stripping off any unreacted stabilizing agent, or any remaining inert compounds, such as light paraffins or by-product, and recovering the oil. If a fluid-bed or intermixed catalyst system is used as in batch-type reactions, the catalyst must be filtered out; filtration is, of course, unnecessary in fixed bed or fluid bed continuous operations.

Figure 13:
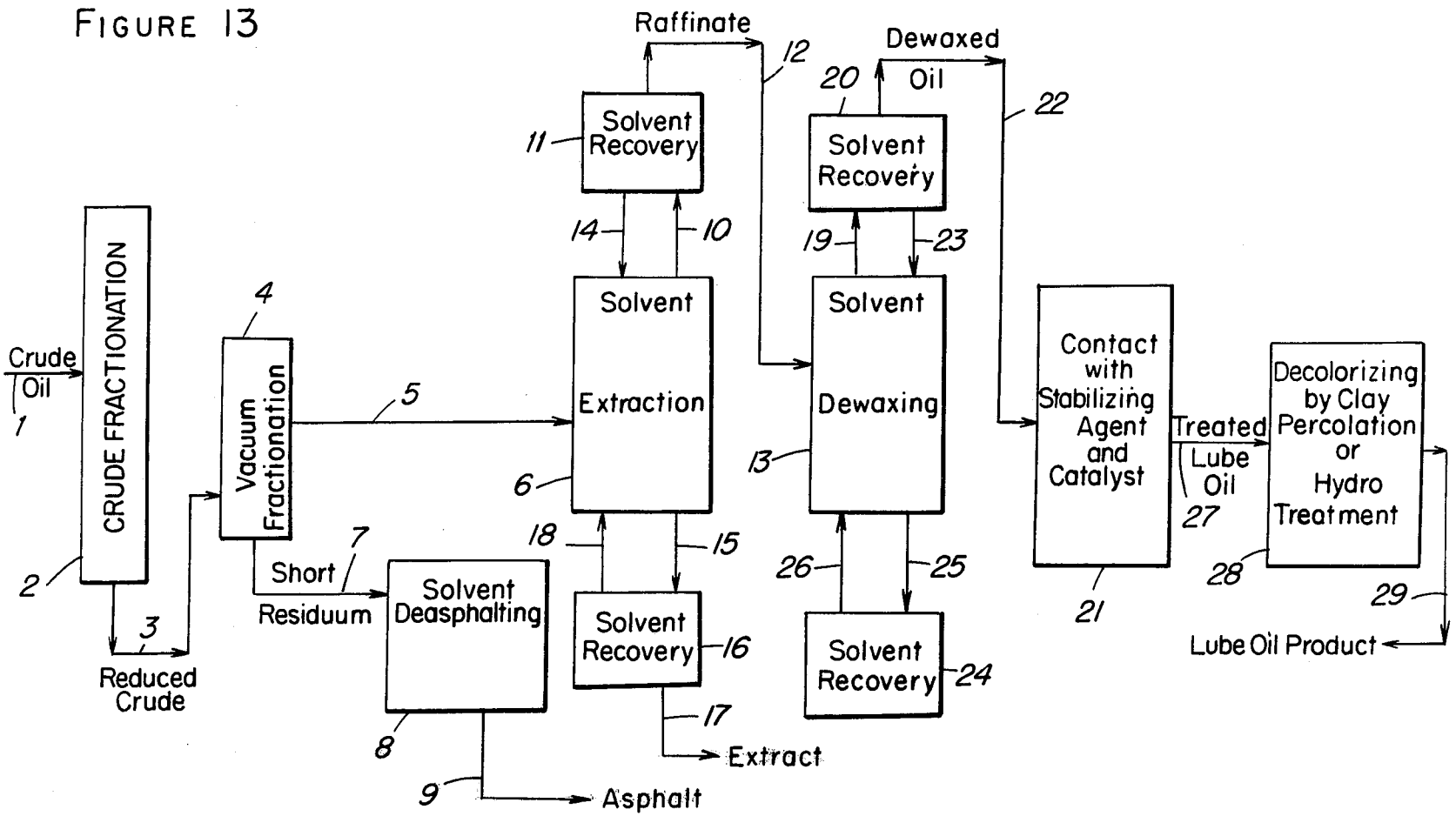
FIG. 13 is a flow sheet depicting one embodiment of this invention to illustrate how the catalytic treatment of this invention may be introduced into a standard lube oil refining operation.

In one preferred embodiment of this invention, the oil that is produced by furfural or other solvent extraction step is dewaxed and then contacted with the stabilizing agent and catalyst according to the process described in this invention. This treated oil may then be clay percolated or hydrotreated in order to decolorize the lube. The overall process for this preferred embodiment for producing lube oils which now includes the contacting of a conventionally treated lube oil with the stabilizing agent is outlined in FIG. 13.

Crude oil is fed via conduit 1 into fractionator 2. One of the products produced by this fractionation is reduced crude which is fed via conduit 3 into vacuum fractionator 4. Light, medium, and heavy oils are produced by this vacuum fractionation and are combined and fed via conduit 5 into solvent extractor 6. Additionally, short residuum is produced by vacuum fractionation and is fed into a solvent deasphalting unit 8 via conduit 7 and asphalt is recovered via conduit 9. Bright stock from deasphalting unit 8 may be combined with the fractionation effluent and passed into the solvent extraction unit 6 (conduit not shown). Raffinate from the solvent extractor is led via conduit 10 into solvent recovery unit 11 and fed via conduit 12 into a solvent dewaxing unit 13. Solvent recovered in unit 11 is returned to unit 6 via conduit 14. The extract from solvent extraction unit 6 is fed via conduit 15 into solvent recovery unit 16 and recovered via conduit 17 and the solvent is returned to unit 6 via conduit 18. Dewaxed oil is led via conduit 19 into solvent recovery unit 20 and fed into the catalytic treatment unit 21 via conduit 22. Recovered solvent is returned to the dewaxing unit 13 via conduit 23 from unit 20. Solvent passing with the wax bottoms into the solvent recovery unit 24 through conduit 25 is returned to the dewaxing unit 13 via conduit 26. Oil that has been contacted with the stabilizing agent and catalyst is fed via conduit 27 into a decolorizing unit 28. Light end fractions may be removed from the unit 21 effluent prior to decolorizing (conduit not shown). Decolorizing is accomplished by either clay percolation or hydrotreating and the finished lube oil product is recovered by conduit 29.

Another preferred embodiment of this invention is the propane deasphalting of a resid bright stock; followed by a dewaxing process; followed by treatment under conditions of this invention; and followed by hydrotreating.

A further preferred embodiment of this invention is the treatment of hydrocracked oils. As is known, the hydrocarbon charge to be cracked is passed with hydrogen in contact with a hydrocracking catalyst, at a temperature within the range of from about 500° F. to about 1,000° F., preferably 600°-850° F. Hydrogen pressure is selected from within the range of from about 1,000 to 10,000 pounds per square inch gauge (p.s.i.g.) and preferably is at least about 1,500 p.s.i.g. The L.H.S.V. of charge normally falls within the range of 0.1 to 10, and preferably 0.2 to 3, volumes of charge (as 60° F. liquid) per volume of catalyst per hour.

The products of hydrocracking are withdrawn and cooled to a temperature at which hydrogen rich recycle gas is separated from the normally liquid product. The normally liquid product is then passed to a fractionator from which several different boiling range fractions including gasoline kerosene, and lube oils are removed. A lubricating oil fraction boiling above about 600° F. and comprising polycyclic compounds constitutes one of the recovered fractions. This fraction is either treated directly, as described above, or first dewaxed and then subjected to treatment.

The oxidation test used in the following examples and the results of which are depicted in FIGS. 1 to 12 is as follows:

The test is conducted in an oxygen circulation apparatus of the type described by Dornte (Ind. Eng. Chem., 28, pages 26-30, 1936) modified so that the rate of oxygen absorption can be recorded automatically. In general, a tube containing an oil sample (30 g) and additive is placed in a heater thermostatted at 347° F. (175° C.). After thermal equilibrium is established, the sample tube is connected with a closed oxygen circulating system. Oxygen is circulated through a fritted glass disk near the bottom of the sample tube at a rate of 5 liters per hour. The smaller the amount of oxygen absorbed in a given period of time, the more stable the oil. In several examples, the time ($t_{1.0}$) required for the absorption of one mole oxygen per kilogram of oil is used to compare oils. The larger the value of $t_{1.0}$, the more stable the oil.

Sludge determinations were conducted by mixing the oxidized oil (30 grams) with 300 ml hexane, stirring overnight, and filtering through a medium frit glass filter (10 to 15 microns).

EXAMPLE 1

One hundred grams of dewaxed furfural-refined 100-second lubricating stock (viscosity 100 S.U.S. at 100° F.) of Kuwait origin were stirred with 4 grams attapulgus clay (benzene/propylene reaction activity rate of about $0.0083\times10^{-2}$) and 6.7 grams of propylene tetramer for 23 hours at 125° C. Analysis by gas chromatography showed that 60% of the olefin had reacted. The catalyst was removed by filtration, and untreated propylene tetramer was removed by vacuum distillation. The catalytically treated oil, when subjected to the oxygen absorption test described above, absorbed 0.50 mole oxygen per kilogram of oil in 20 hours at 175° C., and produced only 0.012 gram of insoluble oxidation products (sludge). In the absence of catalytic treatment, the starting oil absorbed 1.00 mole oxygen per kilogram of oil and produced 0.23 gram of sludge.

EXAMPLE 2

In this example, 2 grams of montmorillonite (activity rate of $1.25\times10^{-2}$ as determined in the benzene/propylene alkylation test) was substituted for attapulgus in the experiment described in Example 1. The montmorillonite has a pore volume of about 0.540 l/kg, a surface area of about 250 $m^2/g$, a density of about 0.65 kg/l, and a particle size of from about 3 to 4 mm. Upon testing, the product oil absorbed 0.33 mole oxygen per kilogram of oil in 20 hours at 175° C., and produced only 0.0062 gram of sludge.

EXAMPLE 3

The Kuwait stock described in Example 1 was treated under the same conditions with attapulgus clay only (olefin was omitted). The product oil absorbed 0.79 mole oxygen per kilogram of oil in 20 hours at 175° C., and produced 0.25 gram of sludge, showing that the olefin is necessary for improvement of the oil.

FIG. 1 shows a comparison of the result of these examples with the untreated oil.

EXAMPLE 4

One hundred cc. of hydrocracked lube oil of 425° F. Pensley-Martin flash point, 5° F. pour point, 1.47307 refractive index, was filtered through a fine glass frit to remove any particulates already present in the lube oil.

To approximately 50 cc. of the above filtered lube oil were added 10 cc. of hexene-1 and 2.5 cc. of a sulfonated ion-exchange resin gel of styrene crosslinked with divinyl benzene in the acid form. The resultant mixture was heated and maintained at 100° C. for 16 hours. A reflux condenser was employed to keep the hexene from escaping and a magnetic stirrer was used to mix the lube oil and the resin catalyst. After the reaction period, the resin catalyst was separated from the mixture by settling and excess hexene was removed by vacuum distillation.

Figure 2:
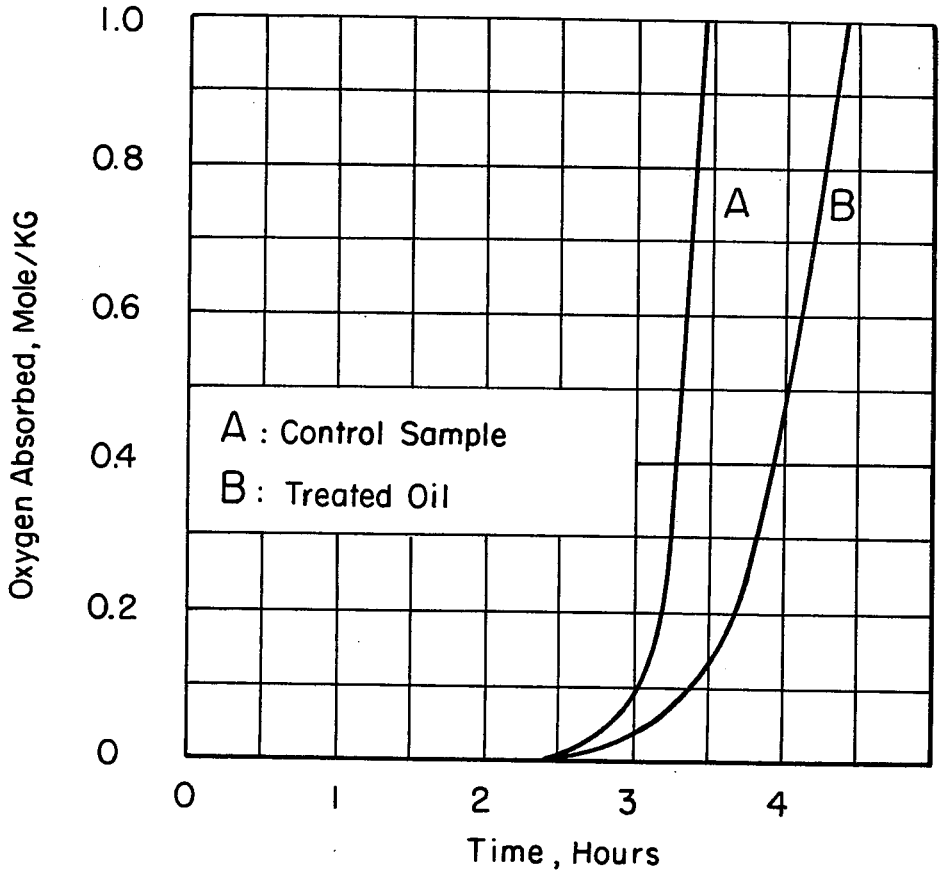
FIG. 2 depicts a comparison of the oxidative stability of a hydrocracked stock treated with hexene vs. the untreated stock as a control.

The final product was tested in the thermal oxidation test. FIG. 2 shows the comparison between this product and a control sample made from the second 50-cc sample which was treated in the same manner except hexene was not added and nitrogen was bubbled through the mixture. As can be seen, the control oil absorbed 1 mole of oxygen per kilogram of oil in about 3.5 hours, while the treated oil absorbed this amount in about 4.4 hours, indicating a longer use life for the treated oil.

The products of Example 4 were also tested for their respective light stability. The light stability test was made by placing the test samples (in a vial 1/5 full) into a photoreactor and observing the appearance of the oil. The photoreactor comprises 16 U.V. lamps of 3,000 Å wave length. The temperature was maintained at 37° C. with a cooling fan. The treated oil was found to be stable for more than 2 weeks. There was little change in color and no sediment was formed. On the other hand, the control sample darkened and a slight haze formed in one day and an appreciable amount of sediment formed in 2 days.

EXAMPLE 5

Using the same procedure and materials as in Example 4, the hydrocracked stock was reacted both with propylene and with butene. The products had improved light stability properties.

EXAMPLE 6

Figure 10:
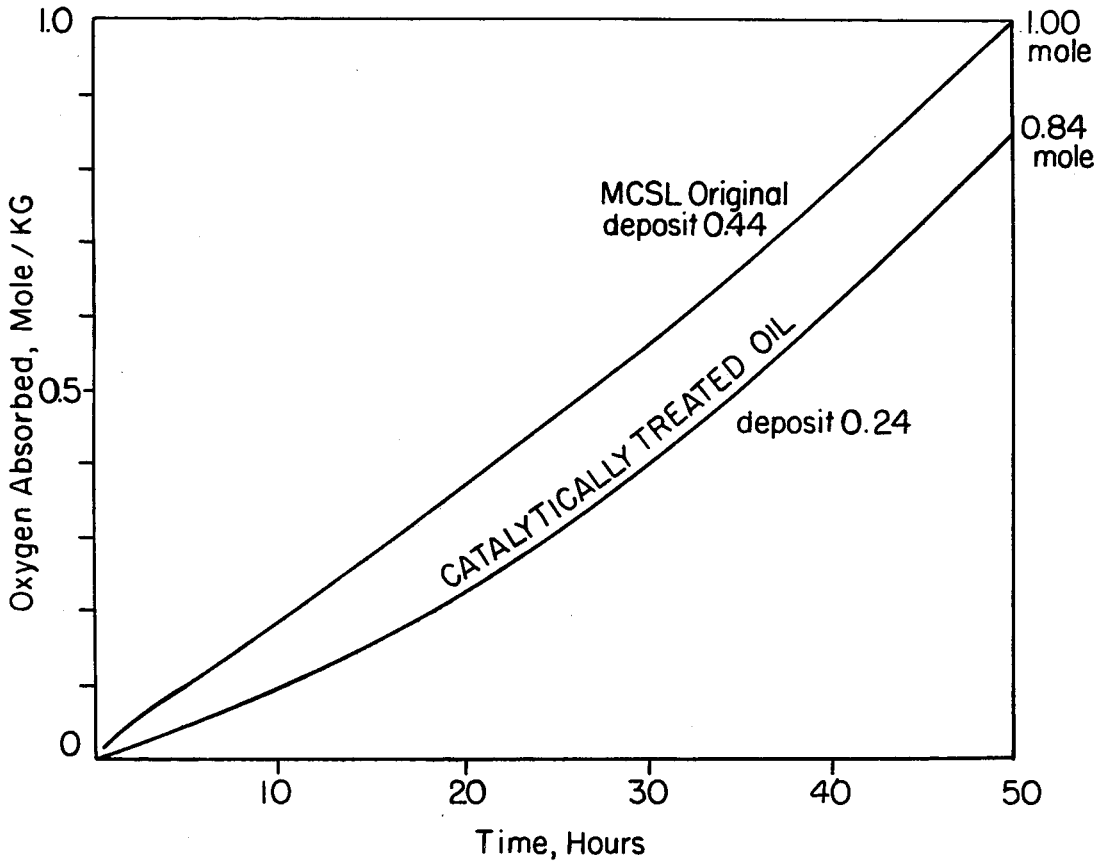
FIG. 10 compares the oxidative stabilities at 175° C. of a Midcontinent stock which has been treated with hexene at 140° C. vs. the original oil.

A reaction mixture consisting of 95 volume percent of a solvent refined Midcontinent 100-second crude (MCSL) and 5 volume percent of hexene-1 was pumped continuously over a sulfonic acid resin catalyst, similar to that of Example 4, except the resin had a higher porosity (0.30 to 0.35 ml pore/ml bead), at 200 p.s.i.g., a space velocity of 1 (1-SV) and 140° C. The effluent was heated to 120° C. under vacuum to remove the unreacted hexene-l. The cleanliness and darkening of oil at high temperatures were visually observed by heating the oil in an open vial over a hot plate at 225° C. A brownish deposit in the form of a ring appeared in the vial containing the untreated oil but was absent in the vial containing the treated oil. This result suggests that the treated oil is cleaner than the untreated oil. Oxidative stabilities were determined with a modified Dornte apparatus at 175° C. using a circulation rate at 5 liters per hour of oxygen. Oxygen absorption was recorded automatically as a function of time. The results are shown in FIG. 10. As indicated, the same stock, untreated, reached l-mole oxygen absorption ($t_{1.0}$) at 50 hours, while the treated stock absorbed only 0.84 mole in that period. Moreover, the untreated stock left a deposit of 0.44 gram per 30 grams of oil; the treated stock left only 0.24 gram.

EXAMPLE 7

Figure 11:
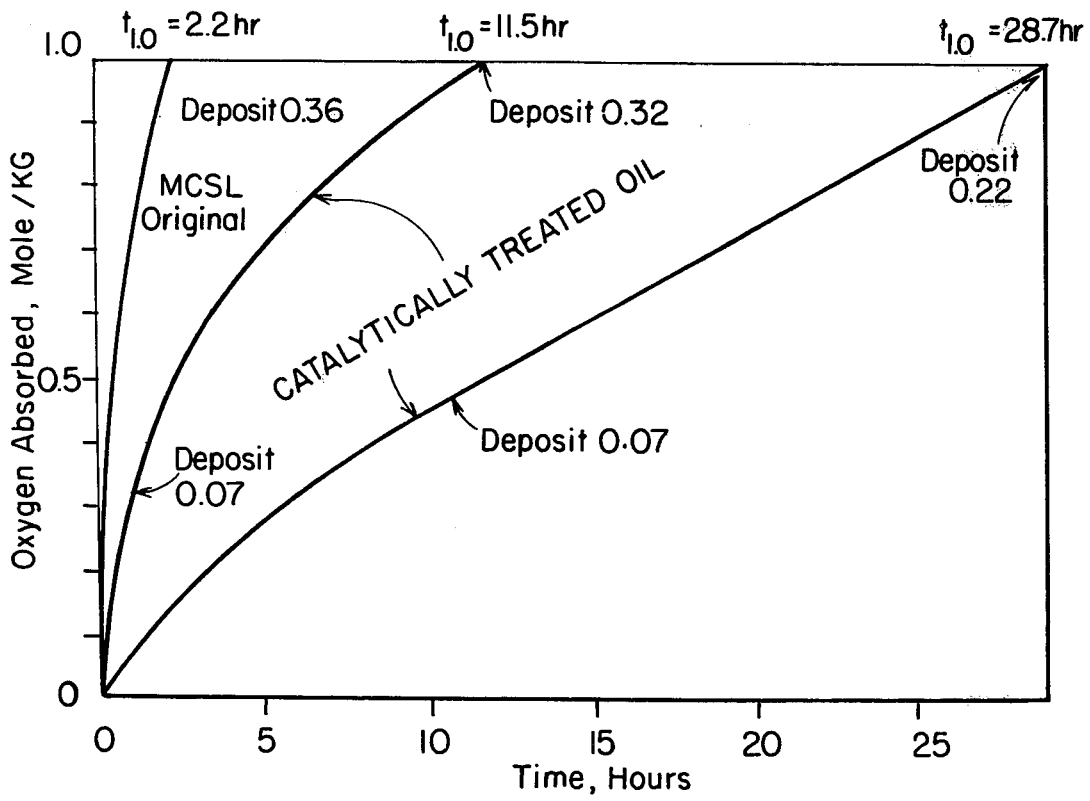
FIG. 11 compares the oxidative stabilities at 175° C. of a Midcontinent stock that has been treated with hexene at 100° C. with the original untreated oil.

Similar lube stock as that used in Example 6, which had been solvent-refined in a laboratory instead of by a refinery operation, was treated in the same manner, except the temperature was 100° C. and a 30-gram sample was used. Another run was also carried out at 100° C. and space velocities of 1 and 2. The results of the oxidation test on untreated stock and the two treated stocks are shown in FIG. 11. The untreated stock had a $t_{1.0}$ of 2.2 hours; the $t_{1.0}$ of the 2-SV treated stock was 11.5; for the 1 -SV treated stock, $t_{1.0}$ was 28.7. At those times, untreated stock left a deposit of 0.36 g/30 g oil/2.2 hours; 2-SV stock, 0.32 g/30 g oil/11.5 hours; 1-SV stock, 0.22 g/30 g oil/28.7 hours. On the basis of grams deposit per gram of oil per hour, the above results would be:

| | |
|---|---|
| Untreated Oil | about 0.00545 |
| Treated Oil (2-SV) | 0.00092 |
| Treated Oil (1-SV) | 0.00025 |

A further run at 1-SV under the conditions of this example, using one similar Midcontinent stock gave product having the following oxidation test results:

| | Untreated Oil[a] | Treated Oil[a] |
|---|---|---|
| Time for $O_2$ uptake of 1 mol/kg. $t_{1.0}$ hr.; | 28 | 29 |
| Deposit, g/30g. of oil; | 0.31 | 0.22 |

a Oil was dewaxed at a different time than the above stock. The deposit was reduced by ⅓ without loss in oxidative stability as indicated by the $t_{1.0}$.

EXAMPLE 8

Two solvent refined Aramco lube stocks were treated with 3% by volume of hexene-1 at 200 p.s.i. and an L.H.S.V. of 1, using the montmorillonite of Example 2 and the resin of Example 4 as catalysts. The base stocks were also varied according to the amount of solvent used in a prior solvent extraction step. The solvent was furfural, a conventional solvent used in refining operations. The two base oils were (a) 100-second and (b) 200-second (about 180 SUS) lube stocks. The treated lubes (and also the untreated lubes as blanks) were tested in the oxidation test. The conditions of treatment and test results are summarized below:

| Base Stock | Furf. Treat Dose, % | Treatment Catalyst | Treatment Temp. °F. | Dornte Test Result $t_{1.0}$, hrs. | Dornte Test Result Sludge, g at $t_{1.0}$ |
|---|---|---|---|---|---|
| (a) | 125 | Blank | — | 25.8[1] | 0.5181[2] |
| | | Resin | 280 | 8.5 | 0.3748[2] |
| | | Mont. | 300 | 40.1[1] | 0.4135[2] |
| (a) | 150 | Blank | — | 11.9(av)[3] | 0.4193(av)[4] |
| | | Resin | 280 | 27.4 | 0.3646 |
| | | Mont. | 300 | 38.0[3] | 0.2849[4] |
| (b) | 200 | Blank | — | 25.5[5] | 0.2961[6] |
| | | Resin | 280 | 29.2 | 0.2030 |
| | | Mont. | 300 | 42.4[5] | 0.1789[6] |

Figure 3:
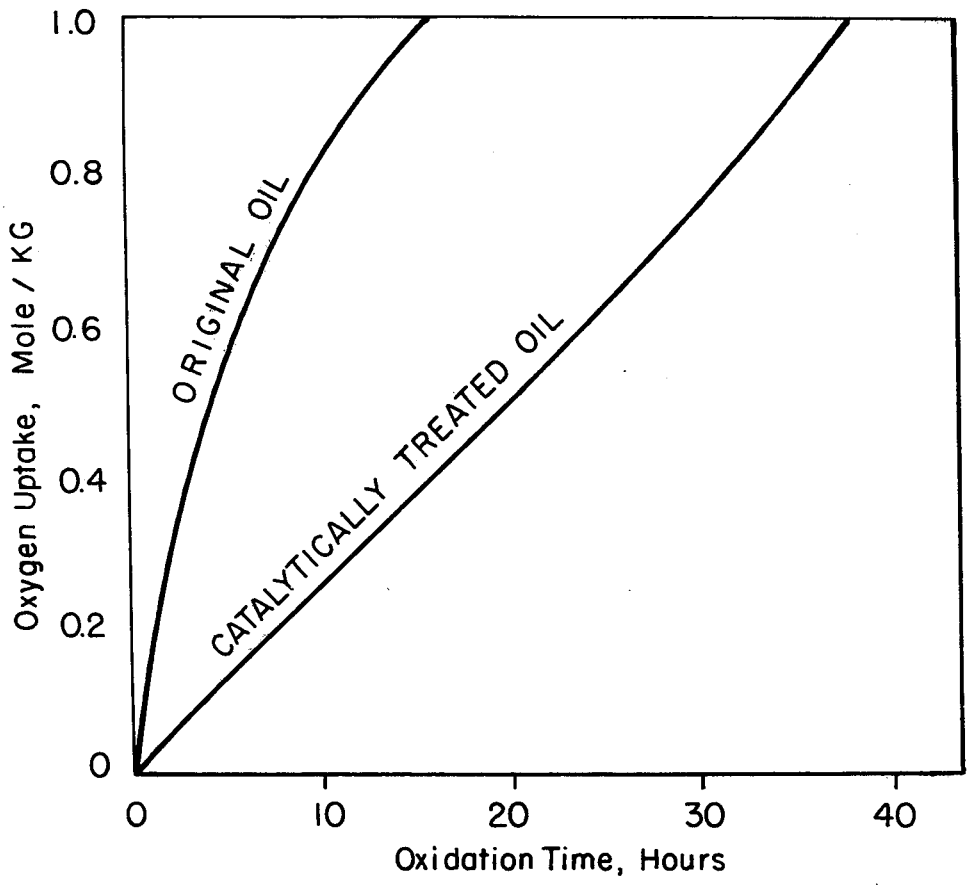
FIG. 3 depicts a comparison of the oxidative stability of an Aramco stock (150% dosage furfural) treated with hexene vs. the original oil.
Figure 4:
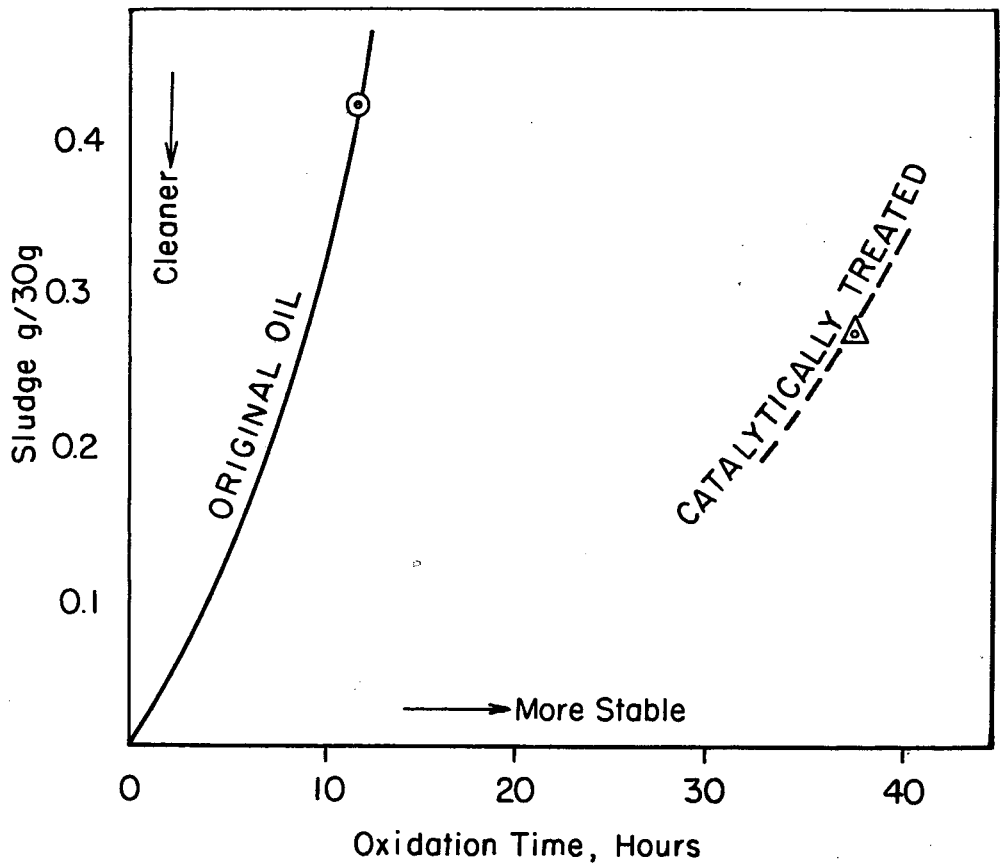
FIG. 4 compares the sludge formation of a hexene-treated Aramco stock (150% dosage furfural) stock vs. the original oil.
Figure 5:
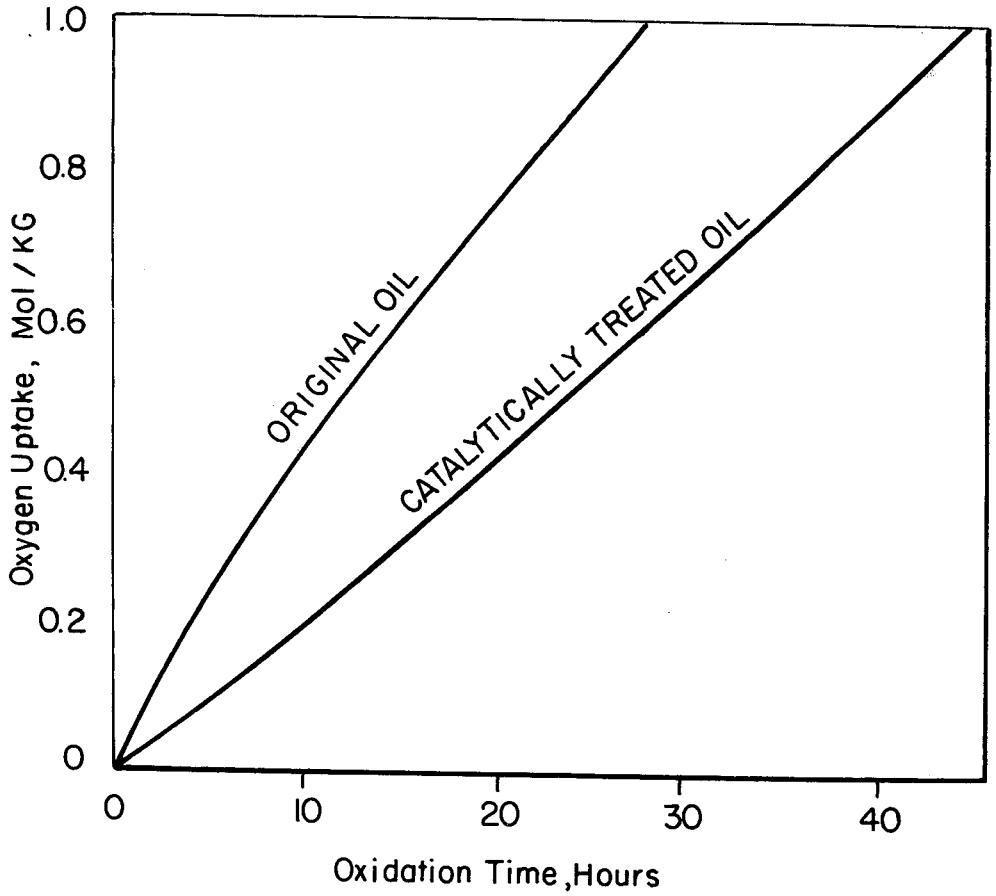
FIG. 5 depicts a comparison of the oxidative stability of Aramco base stock (200% dosage furfural) treated with hexene vs. the original oil.
Figure 6:
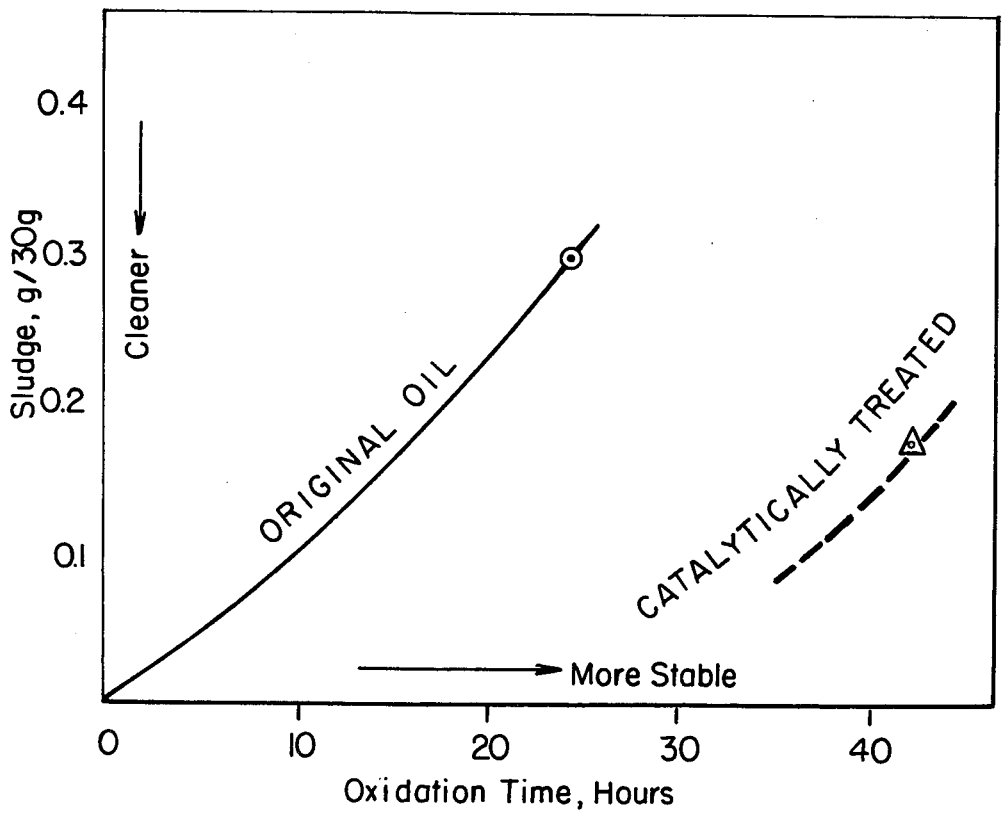
FIG. 6 compares sludge formation of an Aramco stock (200% dosage furfural) of a hexene-treated stock vs. the original oil.
Figure 7:
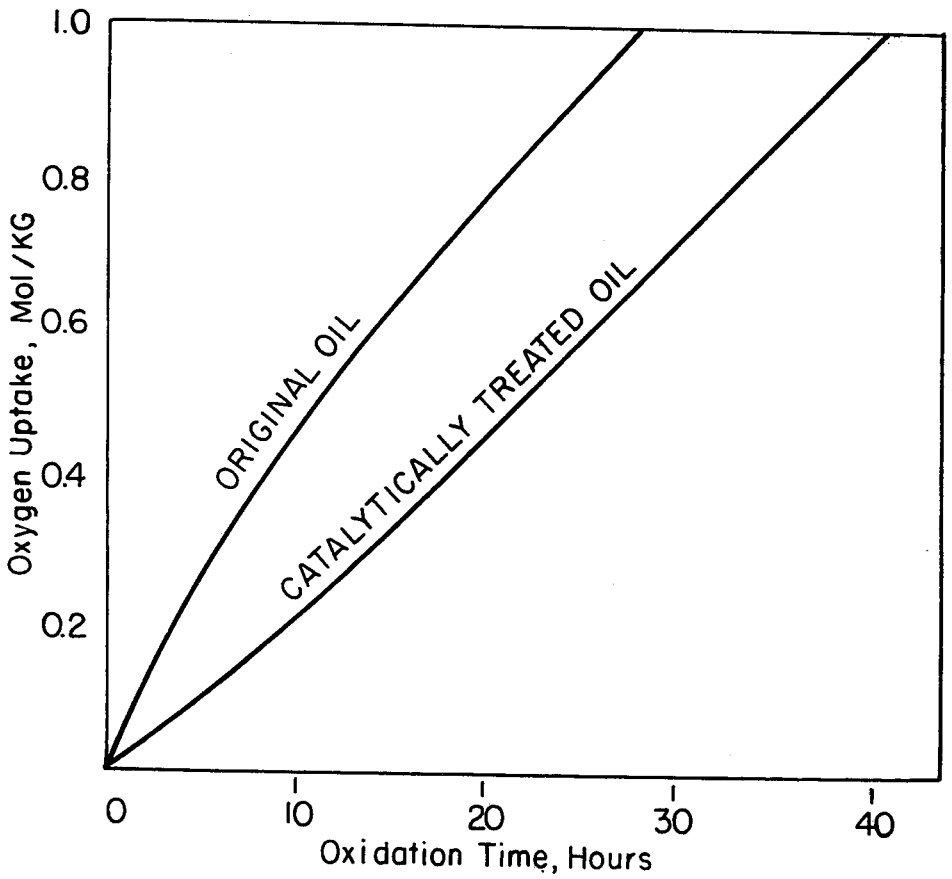
FIG. 7 depicts a comparison of the oxidative stability of Aramco base stock (125% dosage furfural) treated with hexene vs. the original oil.
Figure 8:
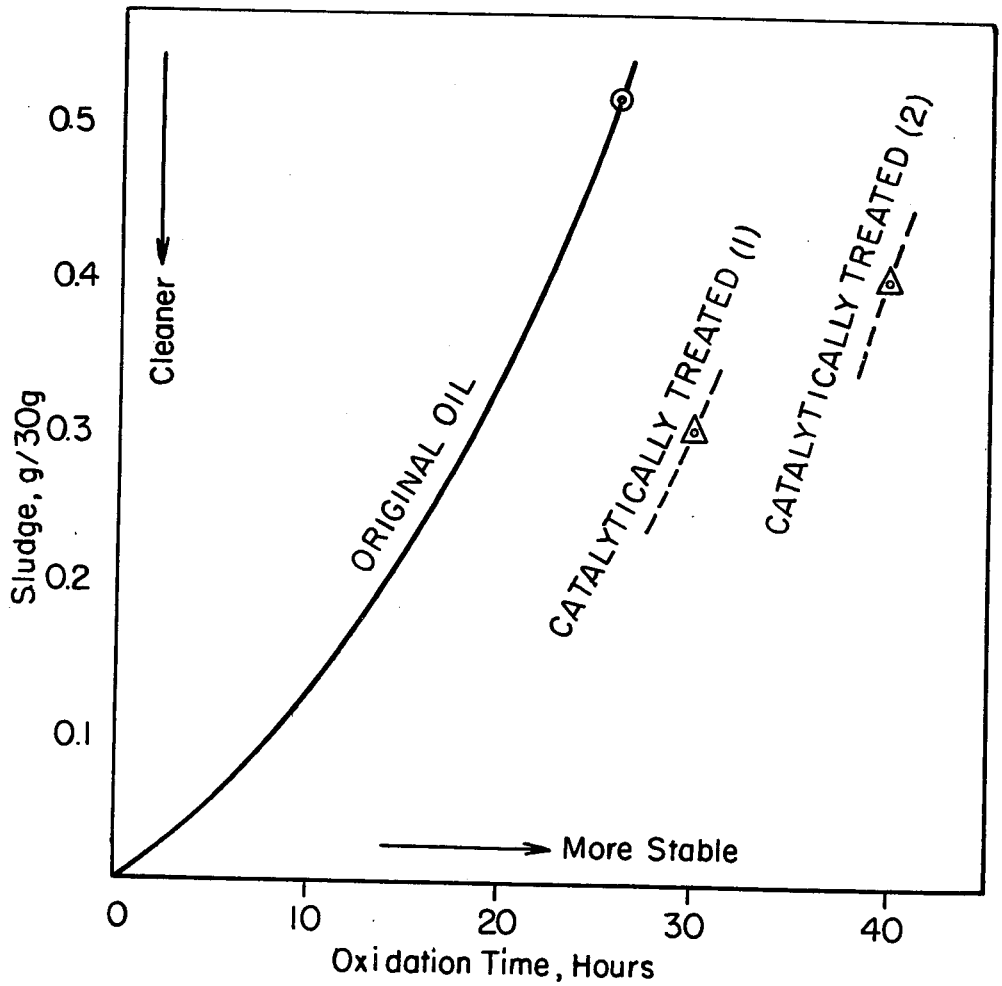
FIG. 8 compares sludge formation of an Aramco stock (125% dosage furfural) subjected to hexene treatment vs. the original oil.

[1]See FIG. 7
[2]See FIG. 8
[3]See FIG. 3
[4]See FIG. 4
[5]See FIG. 5
[6]See FIG. 6

This series of tests shows that oil stock may be improved by the process of this invention at varying levels of solvent extraction severity.

EXAMPLE 9

A solvent-refined Aramco lube stock of 100 SUS was treated with 3% by volume of hexene-1 using a number of catalysts in a continuous flow reactor at a 1-SV, the catalysts being held in a fixed bed. The stock had been solvent-extracted with 180% furfural. Each effluent was tested in the oxidation test, as well as the untreated stock. The stock had been passed through the reactor at 140° F. (A). The catalysts and respective temperatures were:

(B) a crystalline aluminosilicate zeolite of the Y-type (silica to alumina ratio of over 3) the sodium ions of which had been exchanged for rare-earth ions; at 149° C.;

(C) the sulfonated resin of Example 4; at 140° C.;

(D) the montmorillonite of Example 2; at 149° C.; and
(E) the attapulgus clay of Example 1; at 149° C. The results of the oxidation test are as follows:

| Oil over Catalyst | $t_{1.0}$ | Sludge, g at $t_{1.0}$ |
|---|---|---|
| A (none) | 6.2 | 0.33 |
| B | 11.4 | 0.27 |
| C | 20.9 | 0.11 |
| D | 23.5 | 0.23 |
| E | 30.3 | 0.27 |

Figure 9:
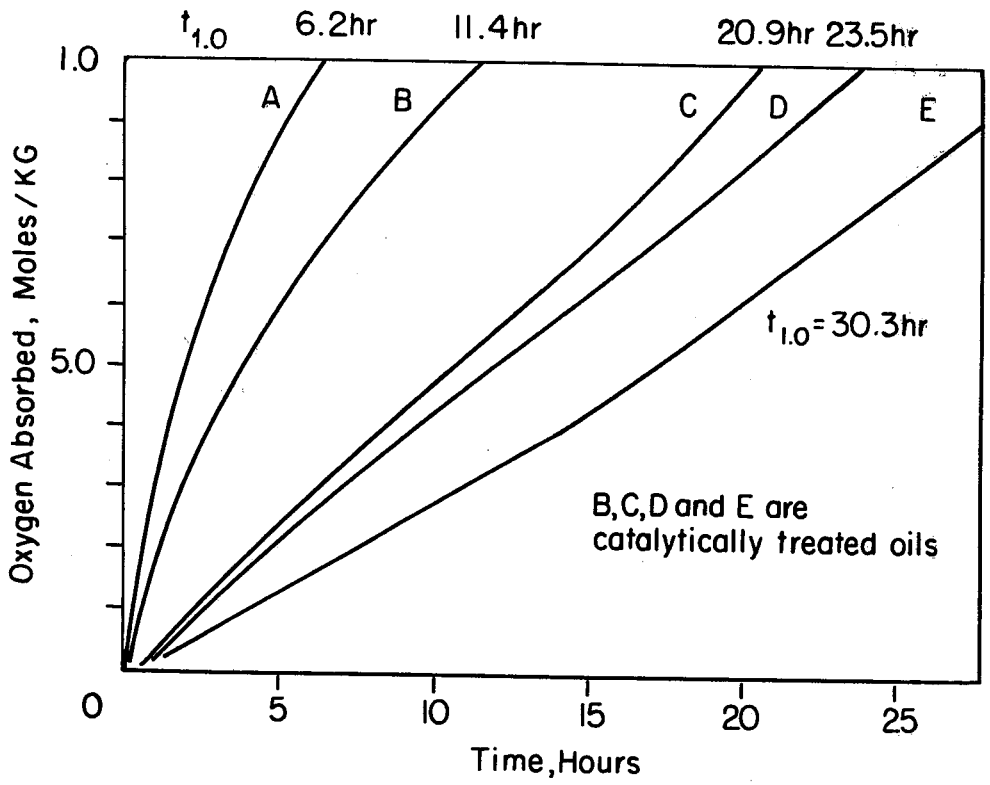
FIG. 9 compares the oxidative stabilities at 175° C. of untreated Aramco stock with stock that has been catalytically treated with hexene with four different acidic catalysts.

The $t_{1.0}$ results are shown in FIG. 9.

EXAMPLE 10

The Midcontinent stock used in Example 7 was treated with hexene-1 at 100° C. using the same sulfonated resin catalyst at 1-SV and 2-SV, and 200 p.s.i.g. The results of the oxidation test on the untreated stock and the treated stocks are as follows:

| Oil | $t_{1.0}$, hours | Sludge, g at $t_{1.0}$ | Deposit at 2.2 hours |
|---|---|---|---|
| Untreated | 2.2 | 0.36 | 0.36 |
| Treated, 2-SV | 11.5 | 0.32 | 0.07 |
| Treated, 1-SV | 28.7 | 0.22 | 0.07 |

These results are depicted graphically in FIG. 11.

EXAMPLE 11

Figure 12:
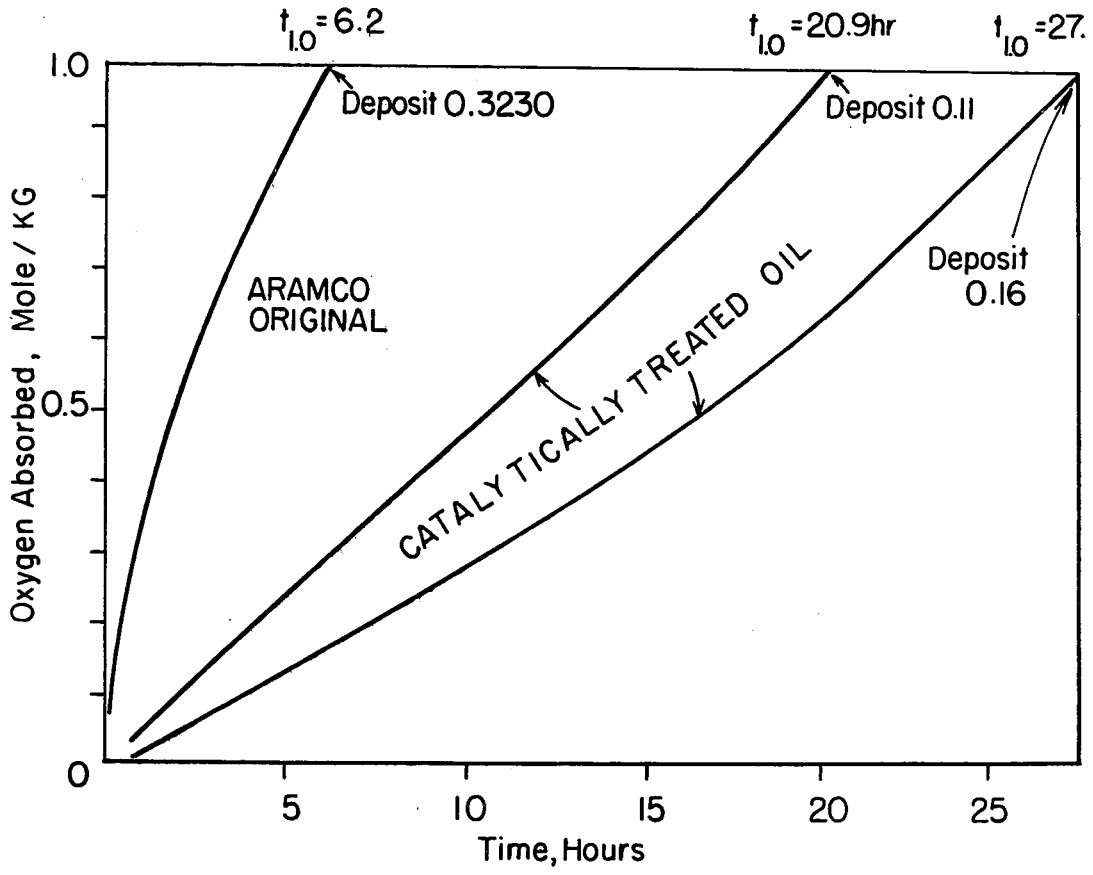
FIG. 12 compares the oxidative stabilities at 175° C. of an untreated Aramco stock with the same stock which has been treated with hexene.

Using the Aramco stock of Example 9, the catalytic treatment was carried out with 3% by volume of hexene-1, both continuously (at 140° C., 1-SV fixed bed catalyst) and batchwise (at 150° C. for 64 hours in a stirred reactor) using the catalyst of Example 10. The oxidation test results, as depicted in FIG. 12, are as follows:

| Oil | $t_{1.0}$ | Sludge, g at $t_{1.0}$ |
|---|---|---|
| Untreated | 6.2 | 0.323 |
| Treated (Continuous) | 20.9 | 0.11 |
| Treated (Batch) | 27.7 | 0.16 |

EXAMPLE 12

A 100 SUS Aramco stock (150%/180° F., furfural-extracted) was combined with hexanol, at a 97/3 weight ratio, respectively. The liquid mixture was passed over the montmorillonite catalyst of Example 2 in a fixed bed at 1-SV and 300° F. The oxidation test results on the treated oil and untreated oil are as follows:

| Oil | $t_{1.0}$ | Sludge, g at $t_{1.0}$ |
|---|---|---|
| Untreated | 9.8 | 0.4217 |
| (Duplicate) | 14.0 | 0.4179 |
| Treated | 40.6 | 0.3892 |

The comparison of the oxidation test results between treated and untreated lube oil stock susceptible to oxidation deterioration normally shows consistent improvment in the treated stocks.

The process of this invention drastically reduces the need to use large amounts of solvent to extract polyaromatic and heterocyclic compounds, and it allows one to produce finished oil, especially lube stock, that exhibits good oxidation and light stability without the need of starting with a high quality crude oil, such as crudes that are substantially paraffinic. The decrease in the amount of solvent required results in a substantial reduction in the loss of valuable mineral oil stock which is inevitable in a conventional solvent extraction process. It should be acknowledged that highly stable crude stocks may not be as greatly improved as the more susceptible stocks, e.g. hydrocracked; however, even minor modification may have benefits in subsequent use.

This invention has been described in both broad and narrow terms; however, obvious modifications of the description are deemed to be within the scope of the invention except as limited by the following claims.

What is claimed is:

1. In a method for producing hydrocarbon lubricating oil, said method comprising solvent extracting a vacuum distillate fraction of a crude oil whereby recovering a hydrocarbon raffinate of reduced polyaromatics and heterocyclic compounds content, and then dewaxing said raffinate, the improvement, whereby reducing the sludge-forming tendency of said raffinate, which comprises admixing from 0.05% to about 15% by weight of a stabilizing agent selected from the group consisting of an olefin, an alcohol, an ester and an alkyl halide with said dewaxed raffinate and contacting said admixture with a heterogeneous inorganic acidic oxide at a temperature between about 25° to 350° C., a pressure of about 0 to 500 p.s.i.g., and at a LHSV of about 0.1 to about 10 to react said stabilizing agent with said raffinate.

2. The method described in claim 1 including, as final step, stripping off any unreacted stabilizing agent.

3. The method described in claim 1 wherein said heterogeneous inorganic acidic oxide has a propylene-benzene alkylation activity rate of at least about 0.003 $\times 10^{-2}$ grams cumene per gram of catalyst per hour.

4. The method described in claim 1 wherein said stabilizing agent is hexanol.

5. The method described in claim 1 wherein said stabilizing agent is an olefin and said heterogeneous inorganic acidic oxide has a propylene-benzene alkylation activity rate of at least about $0.003 \times 10^{-2}$ grams cumene per gram of catalyst per hour.

6. The method described in claim 5 wherein said heterogeneous inorganic oxide is attapulgus clay.

7. The method described in claim 5 wherein said heterogeneous inorganic oxide is montmorrillonite.

8. The method described in claim 5 wherein said heterogeneous inorganic oxide is a crystalline aluminosilicate zeolite.

9. The method described in claim 5 wherein said olefin is hexene-1.

10. The method described in claim 5 including, as final step, stripping off any unreacted stabilizing agent.

11. The method described in claim 1 wherein said distillate fraction is from a hydrocracked oil.

* * * * *